US009782011B2

(12) United States Patent
Liberatore

(10) Patent No.: US 9,782,011 B2
(45) Date of Patent: Oct. 10, 2017

(54) WATER TOY

(71) Applicant: Swimways Corporation, Virginia Beach, VA (US)

(72) Inventor: Raymond A. Liberatore, Bentonville, AR (US)

(73) Assignee: Swimways Corporation, Virginia Beach, VA (US)

( * ) Notice: Subject to any disclaimer, the term of this patent is extended or adjusted under 35 U.S.C. 154(b) by 130 days.

(21) Appl. No.: 13/647,058

(22) Filed: Oct. 8, 2012

(65) Prior Publication Data

US 2014/0099855 A1 Apr. 10, 2014
US 2016/0206107 A9 Jul. 21, 2016

Related U.S. Application Data

(60) Provisional application No. 61/663,548, filed on Jun. 23, 2012.

(51) Int. Cl.

| | |
|---|---|
| ***A63H 23/10*** | (2006.01) |
| ***B63B 35/74*** | (2006.01) |
| ***A47C 15/00*** | (2006.01) |
| ***B63B 35/73*** | (2006.01) |
| ***A63G 19/00*** | (2006.01) |
| ***A63G 31/00*** | (2006.01) |
| ***F41B 9/00*** | (2006.01) |

(52) U.S. Cl.

CPC ..... *A47C 15/006* (2013.01); *A63G 19/00* (2013.01); *A63G 31/007* (2013.01); *A63H 23/10* (2013.01); *B63B 35/73* (2013.01); *B63B 35/74* (2013.01); *F41B 9/0081* (2013.01)

(58) Field of Classification Search

CPC ..... A63H 23/00; A63H 23/005; A63H 23/02; A63H 23/10; A63H 23/16; A63G 19/00; A63G 31/007; A63G 17/00; B63B 35/73; B63B 35/74; B63B 35/78; A47C 15/006

USPC ..... 446/72, 153, 475, 486; 441/129–132

See application file for complete search history.

(56) References Cited

U.S. PATENT DOCUMENTS

| | | | | |
|---|---|---|---|---|
| 1,394,456 A | | 10/1921 | Wanat | |
| 1,610,778 A | * | 12/1926 | Helm | 440/31 |
| 2,092,388 A | * | 9/1937 | Caulkins | A63H 17/002 280/87.01 |
| 2,343,965 A | * | 3/1944 | Fisch | B63B 35/74 441/61 |
| 2,571,266 A | * | 10/1951 | Levay | A63G 17/00 446/29 |

(Continued)

FOREIGN PATENT DOCUMENTS

CN 101721016 A 6/2010

OTHER PUBLICATIONS

Noodle Toys and Chairs product descriptions, downloaded from www.poolcenter.com/pooltoys_noodles_water_logs.htm on Jun. 7, 2012.

(Continued)

*Primary Examiner* — Gene Kim
*Assistant Examiner* — Alyssa Hylinski

(57) ABSTRACT

A water toy comprising a foam tube having a first end, a second end and a body therebetween, an optional seat positioned on the body, a first feature attached to the first end, and a second feature attached to the second end, the first and second features being aesthetic and/or functional and/or a combination of the same.

29 Claims, 18 Drawing Sheets

(56) References Cited

U.S. PATENT DOCUMENTS 2,995,368 A * 8/1961 Moorhead ..... A63G 19/02 280/1.182
3,089,709 A * 5/1963 De Vos ..... B62K 9/02 280/87.05
3,115,804 A * 12/1963 Johnson ..... F16B 21/086 411/338
3,264,160 A 8/1966 Donofrio
3,520,271 A * 7/1970 Harvey ..... 440/22
3,682,474 A * 8/1972 Campbell ..... A63G 17/00 446/29
3,684,282 A * 8/1972 Harms ..... A63G 9/16 472/120
3,822,499 A 7/1974 De Vos
3,835,583 A 9/1974 Manning
4,109,411 A 8/1978 Wetherell et al.
4,193,517 A 3/1980 Fetty et al.
4,241,688 A * 12/1980 Mansolill et al. ..... 482/58
4,302,003 A * 11/1981 Hughes ..... A63G 17/00 441/66
4,435,165 A * 3/1984 Johnson ..... 441/130
4,712,957 A 12/1987 Edwards et al.
4,758,195 A 7/1988 Walsh
4,932,912 A * 6/1990 Combs ..... B63B 35/73 222/78
5,009,413 A 4/1991 Allen
5,143,500 A * 9/1992 Schuring ..... F16B 19/1027 16/38
5,224,633 A 7/1993 Senart
5,231,951 A 8/1993 Tagar et al.
5,356,132 A * 10/1994 McEwan ..... A63B 71/00 273/336
5,474,317 A 12/1995 Piszkin
5,509,831 A * 4/1996 Gelbart ..... 440/27
5,628,658 A 5/1997 Clifford
5,971,823 A * 10/1999 Sanso ..... A63B 67/007 441/136
6,027,393 A * 2/2000 O'Rourke ..... A63B 67/007 222/78
6,123,492 A * 9/2000 Pickard ..... B65D 19/0095 411/339
6,234,858 B1 5/2001 Nix
6,276,979 B1 8/2001 Saltel et al.
6,345,946 B1 * 2/2002 Mainini ..... F16B 5/065 411/339
6,551,193 B1 4/2003 Edwards
6,641,453 B1 11/2003 Morales et al.
D524,881 S 7/2006 Orlowski et al.
7,281,642 B2 10/2007 Orlowski
7,318,762 B2 * 1/2008 Goldmeier ..... A63B 69/12 441/129
7,571,837 B2 8/2009 Orlowski
D606,130 S 12/2009 Wong
D621,449 S 8/2010 Wong
D621,451 S 8/2010 Wong
7,775,849 B2 8/2010 Wong et al.
8,123,077 B2 2/2012 Orlowski et al.
2001/0037758 A1 * 11/2001 Woolley ..... B63B 1/248 114/274
2003/0049983 A1 * 3/2003 Beretich, Jr. ..... A63B 69/0093 441/129
2004/0142614 A1 7/2004 Kirk
2005/0113177 A1 5/2005 Kuo
2005/0196287 A1 9/2005 Olich
2006/0225716 A1 10/2006 Lapointe
2008/0124991 A1 * 5/2008 Kolarick ..... A63B 22/0012 441/129
2012/0242200 A1 * 9/2012 Keragala ..... A47B 47/042 312/111
2013/0034381 A1 * 2/2013 McDonald ..... A63B 69/14 403/164
2013/0052896 A1 * 2/2013 Abraham ..... B63B 35/74 441/129

OTHER PUBLICATIONS

Squirty Head Noodle product description, downloaded from http://www.inyopools.com/Products/09200001035049.htm on Jun. 7, 2012.
International Search Report with Written Opinion for corresponding International Application No. PCT/US 2013/047216 dated Sep. 19, 2013.
Office Action for U.S. Appl. No. 14/410,815, dated Oct. 5, 2015, 10 pages.
Office Action for U.S. Appl. No. 14/410,815, dated May 19, 2016, 11 pages.
Office Action for Chinese Patent Application No. 201380044042.9, dated Jan. 28, 2016, 21 pages.
Office Action for U.S. Appl. No. 14/410,815, dated Nov. 15, 2016, 10 pages.

* cited by examiner

WATER TOY

CROSS-REFERENCE TO RELATED APPLICATIONS

This application claims the benefit under 35 U.S.C. §119 (e) from U.S. Application 61/663,548 filed Jun. 23, 2012, the contents of which are incorporated herein by reference.

FIELD OF THE INVENTION

The present invention relates to a water toy generally, and more particularly to a tubular float, such as foam noodle, having an optional seat support and an aesthetic feature, such as a head and a tail, on either end.

SUMMARY

A water toy comprising a foam tube having a first end, a second end and a body therebetween, an optional seat positioned on the body, a first feature attached to the first end, and a second feature attached to the second end, the first and second features being aesthetic and/or functional and/or a combination of the same.

DETAILED DESCRIPTION OF THE PREFERRED EMBODIMENTS

Figure 1:
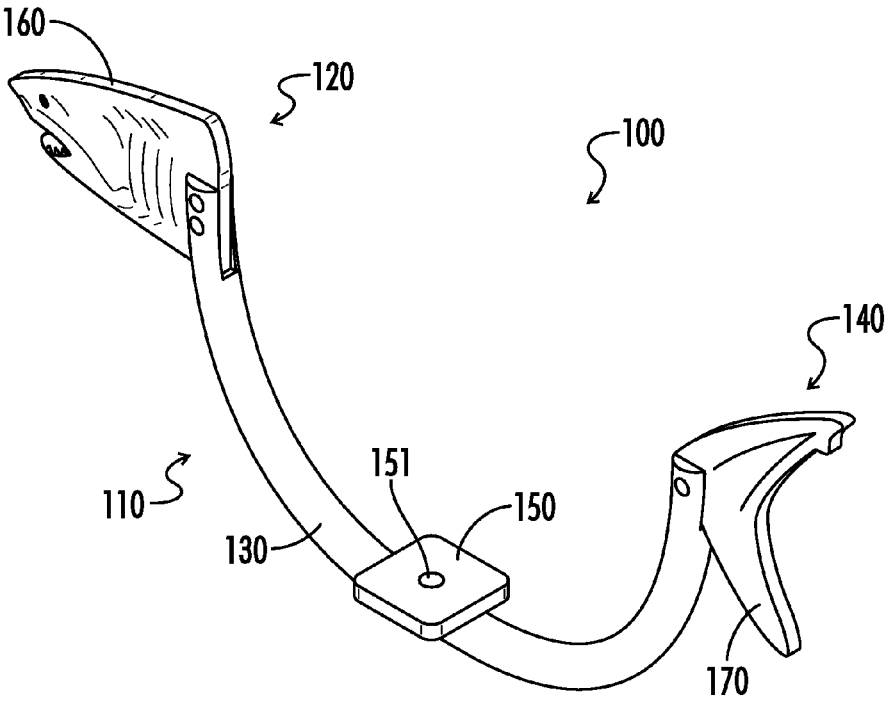
FIG. 1 is a perspective view of one embodiment of a water toy of the present disclosure.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 2:
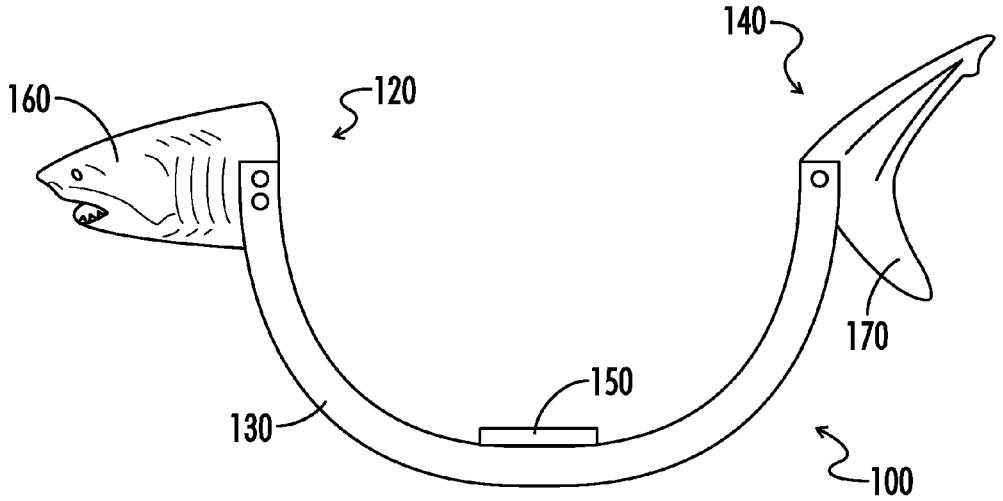
FIG. 2 is a side view thereof.
Figure 41:
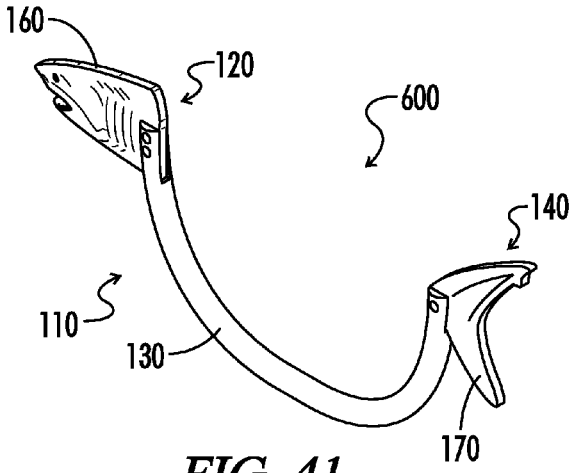
FIGS. 41-43 illustrate various embodiments of a water toy without a seat.
Figure 42:
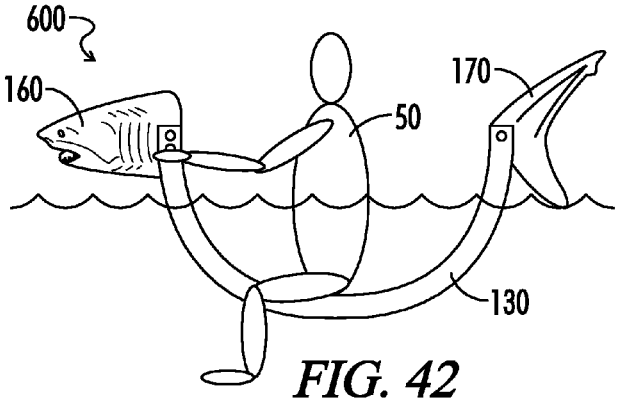
Figure 43:
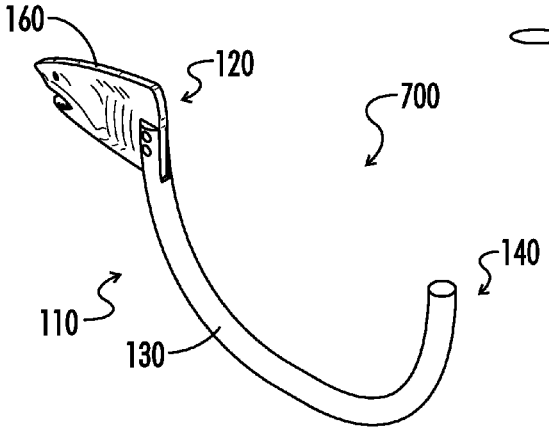

FIG. 1 illustrates a perspective view and FIG. 2 illustrates a side view of one embodiment of a water toy 100 comprising a floatable foam tube 110 having a first end 120, a second end 140 and a body 130 therebetween. In a preferred embodiment, a seat 150 (optional) is positioned on the body 130 between the first and second ends 120, 140, and more preferably somewhere near the middle of the body 130, for supporting a human user 50 (FIG. 3) in the seated position. There is also preferably provided a first aesthetic and/or functional feature 160, such as a head feature, attached to the first end 120 and a second aesthetic and/or functional feature 170, such as a tail feature, attached to the second end 140, each aesthetic and/or functional feature 160, 170 to be described in more detail below. While the use of a seat 150 is preferred, as shown in FIGS. 41-43 there may be provided a water toy 600, 700 without a seat, and as shown in FIG. 43 a water toy 700 may only be provided with a body 130 and a head feature 160 and no seat or tail feature. Other constructional variations are possible.

Figure 4:
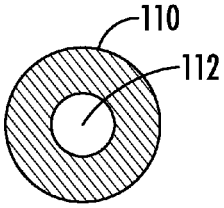
FIG. 4 is one embodiment of a cross-section of a body of the water toy.
Figure 5:
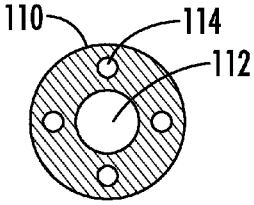
FIG. 5 is an alternative embodiment of a cross-section of a body of the water toy.
Figure 6:
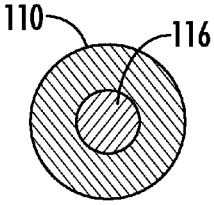
FIG. 6 is an alternative embodiment of a cross-section of a body of the water toy.

The toy 100 is intended to be used in the water, such as a lake, pool, the ocean, a large hot tub or the like. The tube 110 is preferably in the form of a floatable, flexible foam noodle made from a cellular material such as expanded polyethylene (EPE) foam, although other materials could be used. The materials that form the tube 110 can be extruded from a machine or mold or can be created using any process now known or hereinafter developed. The materials can be mixed with air to vary the percentage of air to vary the density so as to adjust the hardness or softness. The size, shape, length, color, texture, thickness, wall thickness, wall configuration, outer surface configuration, outer surface texture, body texture and cross-sectional shape can be any dimension, although it is preferable if the tube 110 could support at least a three hundred pound user, it being understood that a larger tube 110 would be required to accommodate a larger user. Smaller tubes could be used to accommodate smaller users such as children. For example, the tube 110 can have a cross-section that is round (FIG. 4), square, triangle, octagonal, flat, elongated, oval, or any shape possible. The tube 110 may be solid or it may be hollow, and if hollow it may have one (FIG. 4) or more than one (FIG. 5) longitudinal hollow cores 112, 114, or it can have multiple cores running longitudinally or laterally. The cores may have the same cross sectional shape, or it can have different shaped cross sections along the extent of the core, or it can have different size openings on the ends as compared with the middle of the core. Alternatively, it can have a hollow core that is filled with a stiffener material 116 (FIG. 6) like a metal or plastic core that reduces the overall flexibility of the tube but provides strength and/or formability and moldability. In other words, with a core stiffener it may be possible to shape the tube and have it retain its shape if desired. For example, it might be desired to have a stiffer seating area, but a more flexible head/tail area. Alternatively, if the tube 110 has a hollow core 112 (FIG. 4), the core may be used to convey water or other material through the tube for delivery out one of the ends 120, 140 as will be described below.

Figure 3:
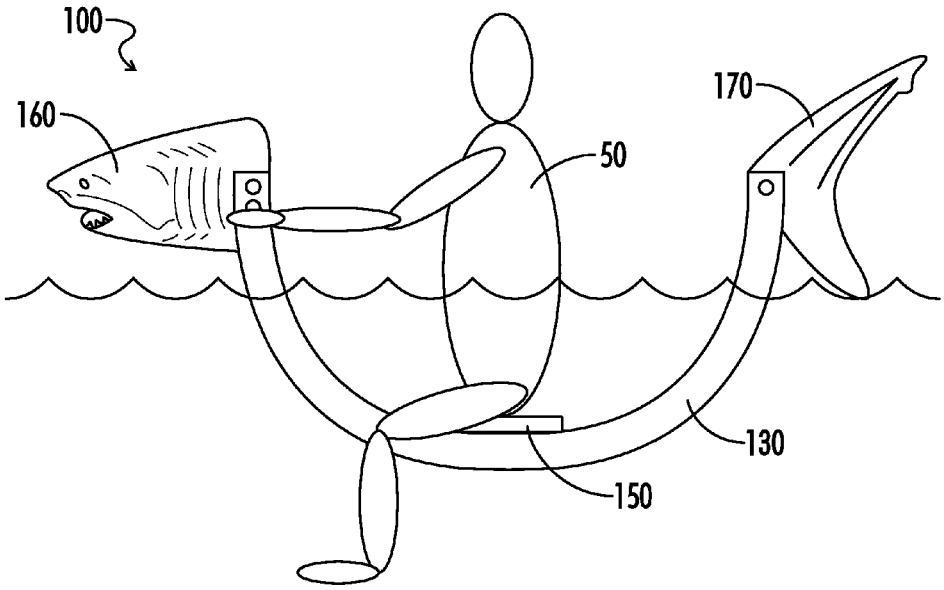
FIG. 3 is a side view of one embodiment showing use of a water toy of the present disclosure.
Figure 7:
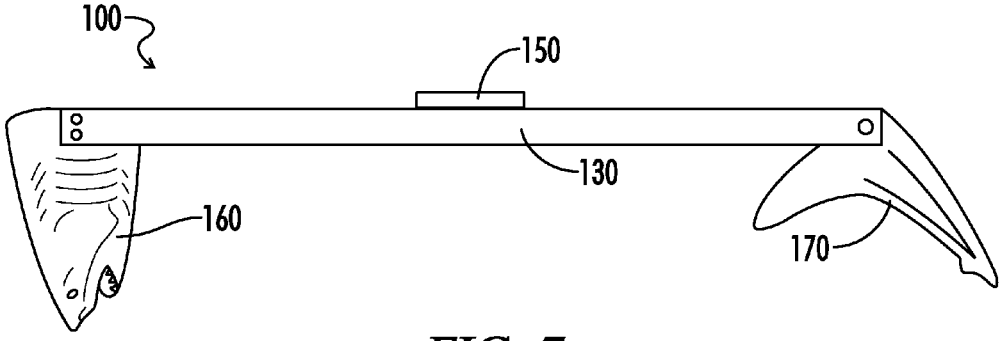
FIG. 7 is one embodiment of the water toy of FIG. 1 shown out of the water.
Figure 8:
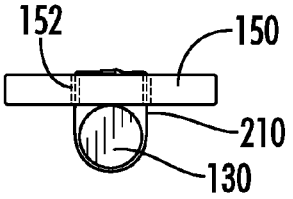
FIGS. 8-9 are various embodiments that illustrate attachment of a seat to a body of a water toy.

The tube body 130 can be formed from a single tubular form, or it can be formed from multiple tubes arranged in parallel (not shown) to create a wider body, or in series (end to end) to create a longer body. However, while the overall footprint of the body 130 can be modified, it is preferred that the length of the body 130 is within a certain range such that when an average adult person sits on the seat 150 in the water, the first and second aesthetic features 160, 170 each extend out of the water in a substantially upright position (see FIG. 3 for example). If the body 130 is too short or if the user is too heavy, the aesthetic features 160, 170 would not stick out of the water or would only slightly stick out of the water, while if the body 130 is too long, the aesthetic features 160, 170 would stick out too much and either look awkward (i.e. not look like a head or a tail) or would lose their upright condition and/or outwardly-directed orientation in the water. For example, if the aesthetic features 160, 170 are in the shape of a fish head 160 and fish tail 170 that are pointing away from each other during use of the toy 100 in the water as shown in FIG. 3, then such features might be facing downward when the toy 100 is out of the water and when the tube body 130 is positioned on a flat surface as shown in FIG. 7, such that when a weight is applied to the seat 150 in the water, the first and second ends 120, 140 assume an upright position which forces the features 160, 170 to assume an appearance of facing away from each other as shown in FIG. 3. Of course, the features 160, 170 can be positioned in any direction relative to the respective first and second ends 120, 140. For lightweight users, such as children under fifty pounds, it might be preferable to omit the seat (see FIGS. 41-43) and to have a shorter body 130 so that the head 160 and tail 170 wouldn't stick out too far. The use of a seat 150 attached to the body 130 also creates a partial horizontal platform that stiffens a portion of the body 130 adjacent the seat 150 and prevents the first and second ends 120, 140 of the body 130 from completely collapsing toward each other upon a user applying force onto the seat 150, thereby allowing the first and second ends 120, 140 to form a U-shaped configuration rather than a sharp V-shaped configuration.

The tube body 130 is preferably provided with holes or connector locations or notches or spaces to connect the seat 150 and any other feature attached to the body 130. This includes, but it not limited to, a back rest, head rest, head or front feature, back or tail feature, as well as extenders coming out near arm level so the user can rest their hands and arms and/or wrap their arms around for comfort (like with lounge chairs), or any accessory now known or hereinafter developed. The body can be provided with a leg rest or a place for a user's feet to rest and it can be of any construction, shape, size or design. The body can also be provided with pedals and paddles separate or attached to the body to enable a user to paddle using the water toy 100. The user can use feet or hands to paddle and move around the water. There could also be foam or rubber fins that fit over the user's hands or feet so they can use to paddle or push water forward or backward to move around and navigate in water instead of using their feet and hands. The body 130 can have extra frame or legs coming out like octopus legs. The body 130 can also be shaped like a boat where there's a bow and a stern, or like a submarine, or like a car, or any way possible.

Figure 40:
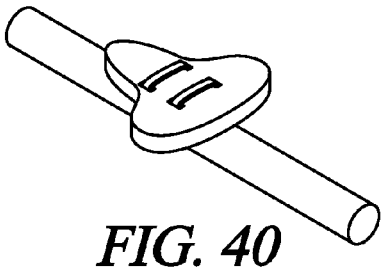
FIG. 40 illustrates one embodiment of a bicycle-type seat attached to a body portion of a water toy.

With water toys that incorporate a seat 150, the seat 150 can be any size, shape and thickness and can be dimensioned to accommodate one or more people, including having multiple seats positioned along the width or length of the body 130. While the use of a seat is preferable in the illustrated embodiments, it is optional, along with having multiple seats. For example, there could be two seats or an elongated seat for use by more than one rider at a time. The seat can be smaller and narrower in the front and wider in the back, for example. The seat 150 can be shaped like a bicycle seat (see FIGS. 40 and 50), such as like a beach cruiser, and it can have any type of decoration or ornamentation. The edges of the seat, as well as any construction used to attach the seat to the tube, are preferably rounded or tapered (see FIG. 50) so the user will have more comfort.

Figure 28:
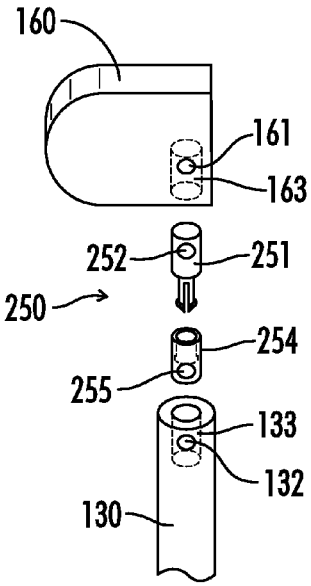
FIGS. 28-30 illustrate one embodiment of attaching a head feature to a body.
Figure 29:
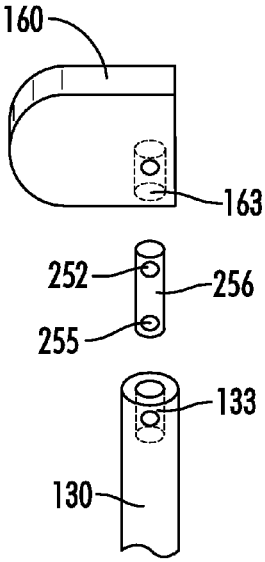
Figure 30:
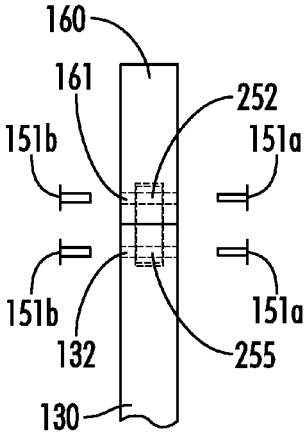

The seat 150 is preferably connected to the body 130 of the tube 110 by any means now known or hereinafter developed. For example, the seat 150 may have one or more holes 152 that accommodate straps 210 for strapping the seat 150 to the body 130. Alternatively, the seat 150 may utilize a single fastener 151 (FIGS. 1, 20) that extends through the seat 150 and is bolted or riveted the body 130 for a semi-permanent connection. FIGS. 20-23 illustrate variations of a fastener 151 formed from a first section 151*a*, 151*aa* (threaded), 151*aaa* (pin) that engages with a second section 151*b*, 151*bb* (threaded), 151*bbb* (riveted) through an opening 152 (FIG. 20) or openings 152 (FIG. 21) in the seat 150 and respective openings 132 in the body 130. These fasteners 151 create a permanent or semi-permanent connection between the seat 150 and body 130. FIGS. 24-27 illustrate a similar engagement of a head feature 160 with a notch 121 in the body, and more specifically the extension of a fastener 151 (one or two pieces or more) through an opening 161 in the head feature 160 and through openings 122 within the notch 121 in the end 120 of the body 130 that secures the head feature 160 to the notch 121 and to the body 130. Because the body 130 and head feature 160 are preferably formed from foam, it is also preferable that all of the respective openings are lined with some type of material, such as plastic or the like, that retains the shape of the openings and prevents the fasteners from enlarging the openings through normal use. FIGS. 28-30 illustrate yet another embodiment of a different type of fastener 250 formed from a first piece 251 that is inserted into an opening 163 in the head feature 160, the first piece 251 having a first opening 252, and a second piece 254 that is inserted into an opening 133 in the body 130, the second piece 254 having an opening 255. The first piece 251 attaches to the second piece 254 (FIG. 28) to form a single fastener tube 256 (FIG. 29), and then fastener elements 151*a*, 151*b* are attached through the openings 252, 255 and through cooperating openings 161, 132 in the head feature 160 and body 130 respectively to attach the head feature 160 to the body 130 (FIG. 30).

Figure 44:
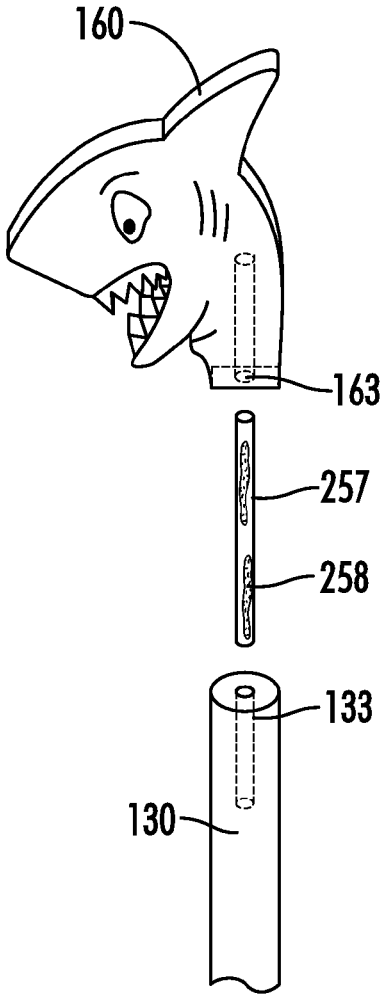
FIG. 44 illustrates an exploded view and FIG. 45 illustrates an assembled view of one embodiment of head feature being attached to a body using a fastener tube.
Figure 45:
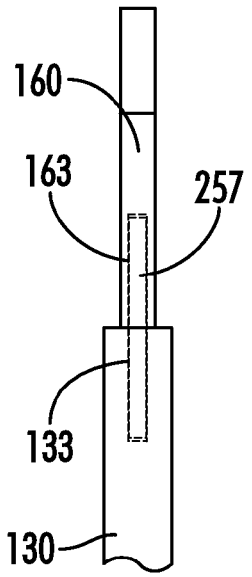
Figure 46:
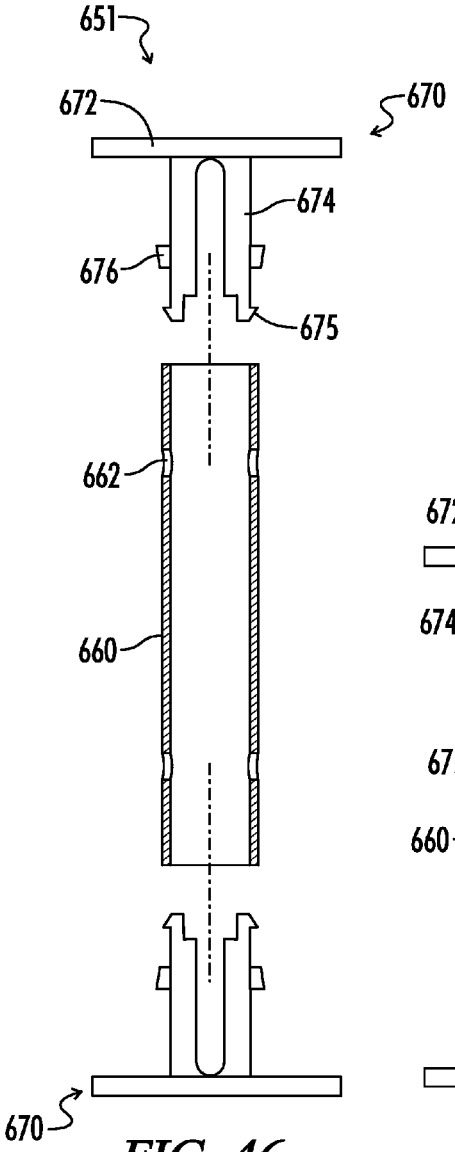
FIGS. 46-49 illustrate various components of one embodiment of a fastener device.
Figure 48:
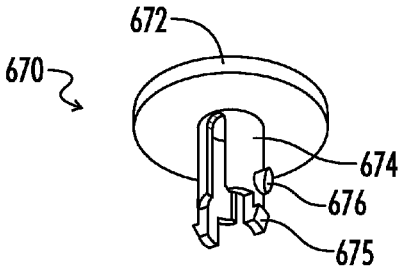
Figure 47:
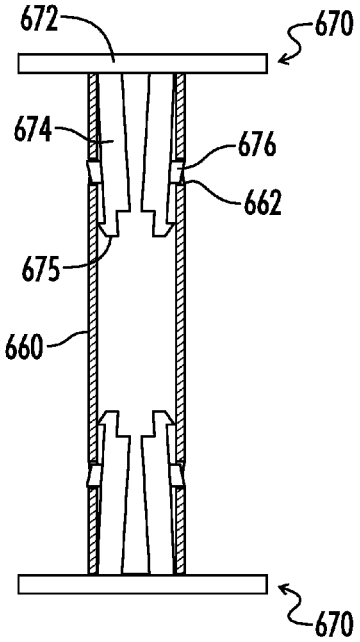
Figure 49:
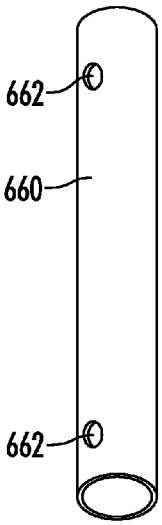

FIGS. 44-45 illustrate yet another embodiment of a single fastener tube 257 lined with an adhesive 258 that is inserted into an opening 163 in the head feature 160 and into an opening 133 in the body 130. The adhesive 258 secures the fastener tube 257 within the openings 163, 133. The size, cross section, shape and depth of the openings 163, 133 can be variable to accommodate the configuration of the fastener tube 257, which can be any size, shape, thickness, cross section or material composition such as ABS or PVC plastic or another material that will bond with the adhesive 258 and with the foam material of the body 130. The adhesive 258 is preferably water-resistant and safe for children and the environment. The diameter of the openings 163, 133 are preferably slightly smaller than the diameter of the fastener tube 257 to create a secure fit between the two.

Figure 50:
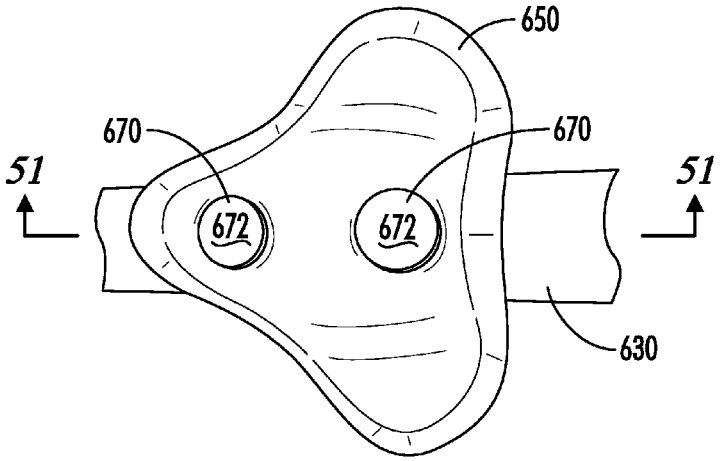
FIG. 50 illustrates a top view of a seat attached to a body and FIG. 51 illustrates a cross-section taken through line 51-51 of FIG. 50.
Figure 51:
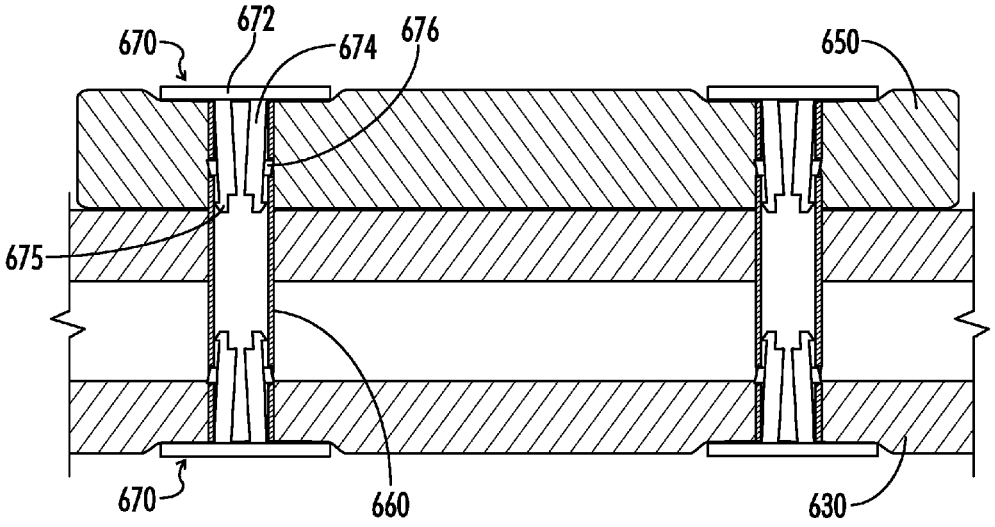

FIGS. 46-49 illustrate another embodiment of a fastener 651 formed from a fastener tube 660 having openings 662, and a pair of fastener caps 670 having a wide flange 672 and prongs 674 with notches 676 that engage the openings 662 in the fastener tube 660. While two prongs 674 with two notches 676 are shown, it will be appreciated that any number of prongs and notches may be used. The prong ends 675 are angled to persuade the prongs 674 to deflect inward toward each other upon insertion of the cap 670 into the tube 660. The prongs 674 deflect outward upon the engagement of the notches 676 with the openings 662 to create a permanent or semi-permanent connection between the caps 670 and the fastener tube 660. The fastener 651 could be used to secure a seat 650 to a body 630 as shown in FIGS. 50-51, where the seat 650 and body 630 are provided with openings 652 and 632 respectively for first receiving the fastener tube 660 and then a fastener cap 670 on either end of the fastener tube 660 for attaching the fastener 651 to the seat 650 and body 630. While the seat 650 is shown with a bicycle seat configuration with two openings 652 (one on the front and one on the back), it will be appreciated that any number of openings may be used and that any seat shape may be used. The wide flanges 672 connect and sandwich together the body 630 and the seat 650, and it's preferable to have a wide flange on the cap 670 because the wider the flange the more area that's touching the body 630 and the seat 650, which prevents the body 630 and the seat 650 from becoming separated. While a circular flange 672 is shown, it will be appreciated that the fastener components could be any size, shape, cross section or material composition, although it is preferred to use a strong plastic like ABS plastic so that there is no shrinkage or wear problems with the prongs 674 and notches 676. Also, while a pair of identical caps 670 is shown, it will be appreciated that a different cap may be used for the seat 670 and the body 630. While the fastener 651 preferably forms a permanent or semi-permanent connection, the fastener can also be designed to be removable. The caps 670 that are exposed to the outside can be the same color as the seat 650 or body 630 or any color. It is also preferred if the total length of the fastener 651 is slightly shorter than the seat 650 and body 630 as shown in FIG. 51 to create a tight, compressive fit at the outset and to account for wear and weathering of the seat 650 and body 630.

Figure 9:
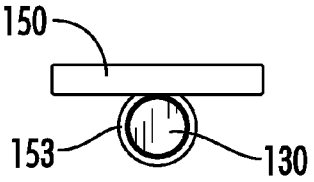
Figure 10:
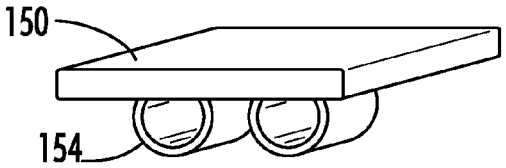
FIG. 10 illustrates one embodiment of a seat for a water toy having two bodies.
Figure 11:
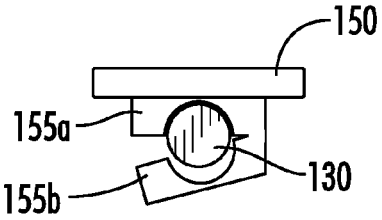
FIGS. 11-15 are various embodiments that illustrate the clamping attachment of a seat to a body of a water toy.
Figure 12:
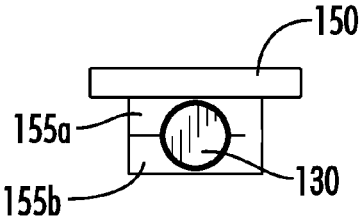
Figure 13:
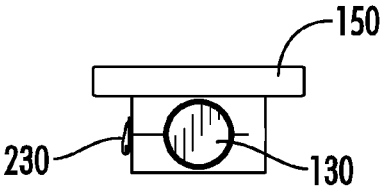
Figure 14:
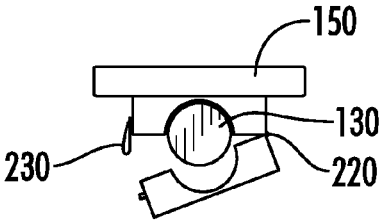
Figure 15:
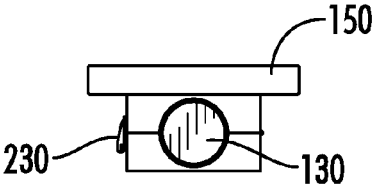
Figure 16:
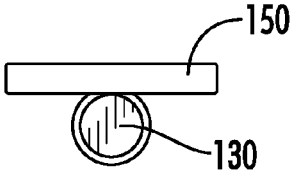
FIG. 16 illustrates one embodiment of a seat molded with a body.

The seat 150 can have a ring-like extension 153 (FIG. 9) that accommodates the body 130 therethrough, where the seat 150 is slid onto the body 130 (like sliding a ring onto a finger) before the first and second features 160, 170 are attached to the first and second ends 120, 140, which would allow the seat 150 to be slid and repositioned along the length of the body 130 as desired, which would be helpful if the weight and/or number of people using the seat 150 is variable. Alternatively, two ring-like extensions 154 (FIG. 10) may be used if the seat 150 is going to be applied to two bodies 130 at the same time. The seat 150 could also be formed from two halves 155*a*, 155*b* (FIGS. 11-15) that encircle the body 130 and removably clamp onto the body 130 through a hinge 220 and/or latch 230 mechanism, where the body 130 is sandwiched between the seat halves 155*a*, 155*b*. The seat 150 can also be molded with the body 130 as a single, permanent piece (FIG. 16) during the point of manufacture. The seat 150 can also be attached so that it automatically detaches from the body 130 under extreme wear and tear, or under an extreme force where the safety of the user might be in jeopardy.

Figure 52:
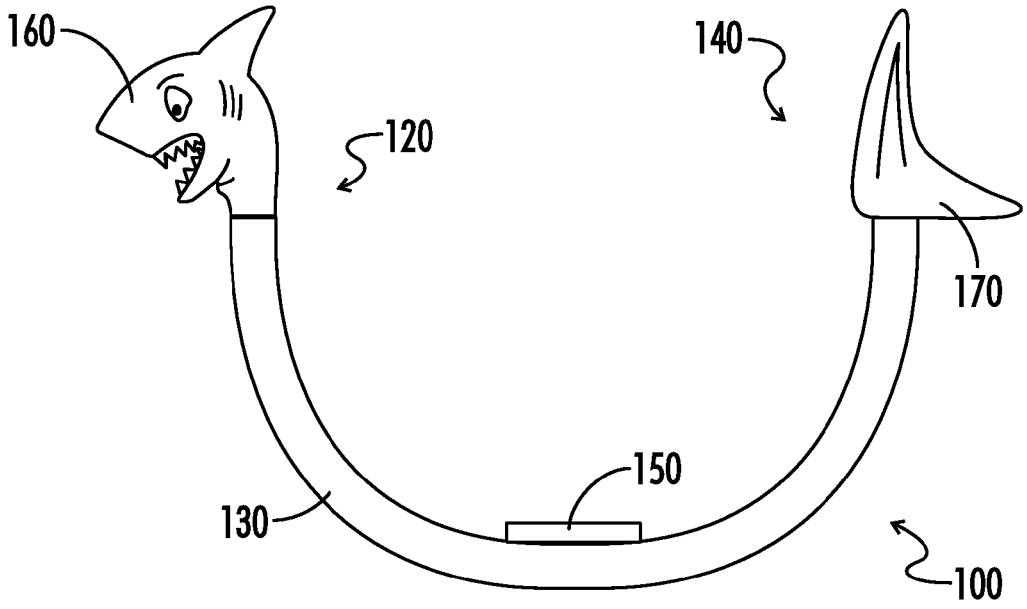
FIGS. 52-55 illustrate various embodiments of a water toy.
Figure 53:
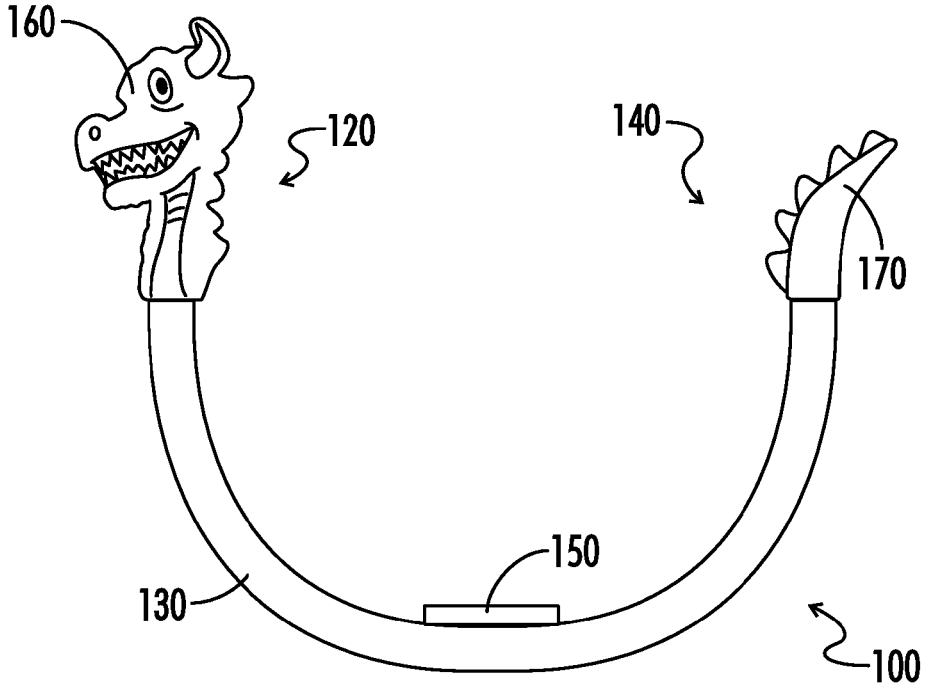
Figure 54:
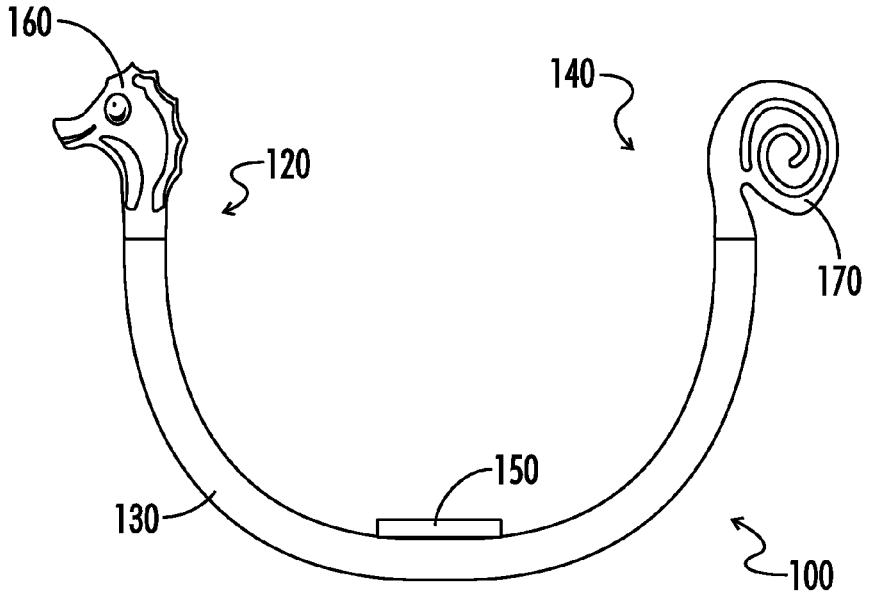
Figure 55:
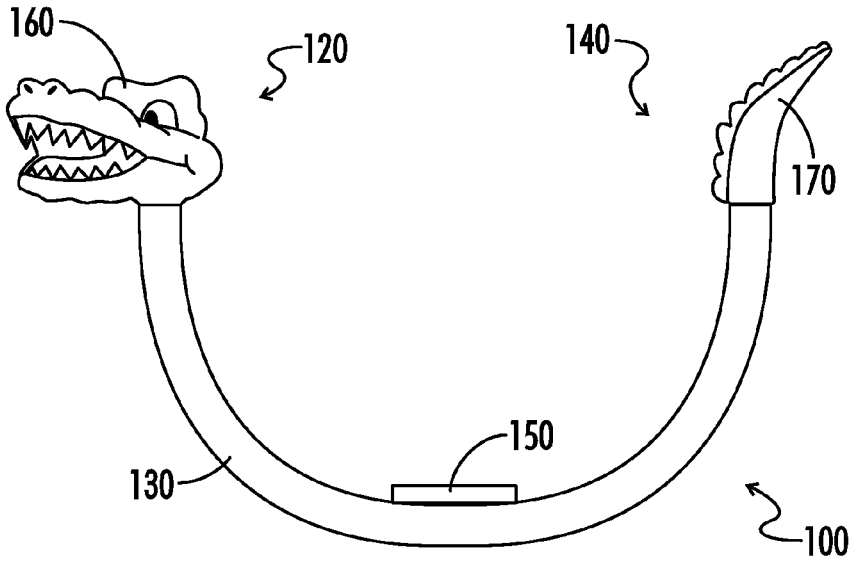

The first and second aesthetic features 160, 170 are described as respectively associated with the first and second ends 120, 140, where the first end 120 is typically associated with a "head" feature 160 and the second end 140 is typically associated with a "tail" feature 170, although it is understood that the features could be interchanged and/or not appear like a head or a tail, for example. There could be one or multiple head features 160 or tail features 170, or combinations of the same. The head feature 160 can be any size, shape, color, construction, cross-section, or thickness, where the color could match the type of animal for example, such as a gray dolphin or a green alligator. For example, the head feature 160 could be designed as any shape now known or hereinafter developed including, but not limited to, sharks (FIG. 52), dragons (FIG. 53), sea horses (FIG. 54), alligators (FIG. 55), dolphin, whales, fish, tropical fish, people, products, cartoon figure, action figures, cannons, eels, snakes, walrus, mermaids, or any animal or sea creature. The head or tail features 160, 170 could be oriented in opposite directions or the same direction or combinations of the same or different directions if there are multiple head or tail features. The head and tail features 160, 170 can have silk screen print, paint, foam or the like on each side that mirror each other so it creates the appearance of a right side and a left side. There can also be two-headed head feature in the front and a single tail feature in the back, like a two headed dragon, both head features having squirt guns if desired. The head and/or tail features can be smaller or bigger than the main body or noodle, for example. The head and tail features can be formed from one or more than one layers of material, it can be stiff or flexible, and can be permanently attached or removably attachable in the same manner as described in connection with the seat. For example, the head feature 160 could be made to detach under extreme wear and tear or in response to an extreme force where it might be required to protect the safety of the user. The colors in the head and tail features 160, 170 can be matching, and also with the seat 150 and/or the body 130, or each feature could use a combination of similar or different colors.

Figure 17:
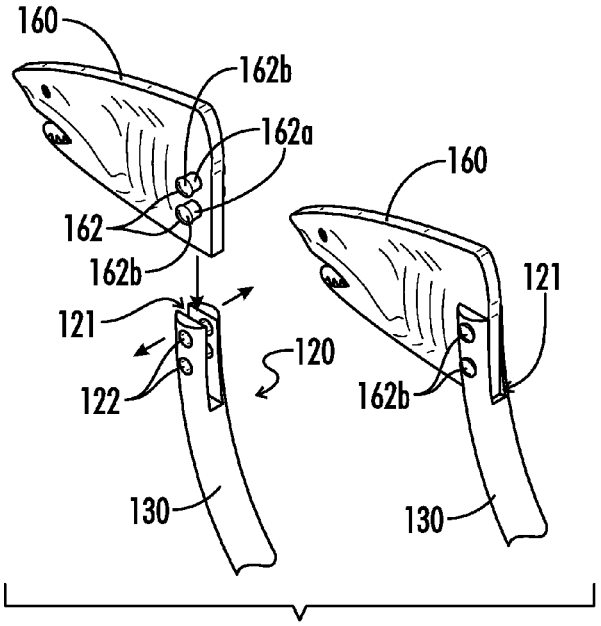
FIG. 17 illustrates one embodiment of a head feature being attached to a body of a water toy.

FIG. 17 illustrates one example of a removable head feature 160 having a pair of pegs 162 formed from shafts 162*a* having enlarged ends 162*b* that are pressed into openings 122 on the end 120 of the body 130. The process of engaging the head feature 160 with a notch 121 in the end 120 of the body 130 causes the notch sections 121 of the end 120 of the body 130 to spread apart slightly as the head feature 160 is forced into the notch 121, whereby the notch sections will be compressed over the enlarged ends 162*b* of the pegs 162 until the enlarged ends 162*b* extend through the openings 122 and the retained the head feature 160 is seated within the notch 121 of the end portion 120 of the body. Thus, in order to detach the head feature 160 from the body 130, in one embodiment, the head feature 160 is simply pulled with enough force to disengage the enlarged ends 162*b* from the openings 122 and extract the shafts 162*a* through the openings 122.

Figure 18:
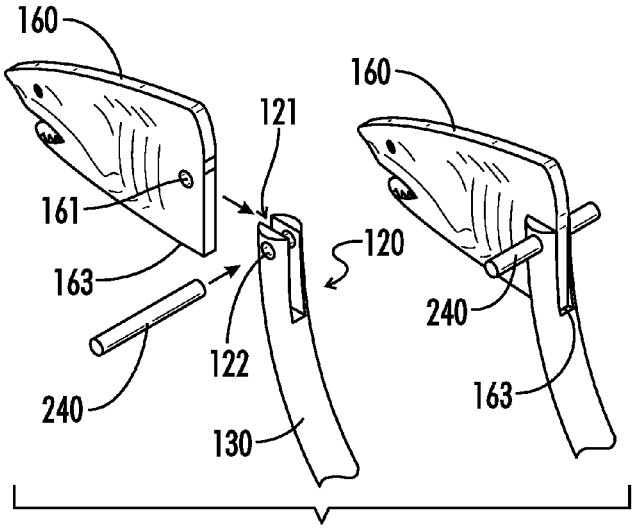
FIG. 18 illustrates one embodiment of a head feature being attached to a body with a handlebar.

FIG. 18 illustrates another example of a removable head feature 160 that is attached to the end 120 of the body through the extension of a handle 240 through an opening 161 in the head feature and through openings 122 on the end 120 of the body 130. The head feature 160 is retained in place in the notch 121 in the body 130 by virtue of a flattened lower surface 163 that is seated within the notch 121 that inhibits the head feature 160 from rotating within the notch 121 during normal use. The handle 240 can then be used as a hand rest or the like. If the head feature 160 includes a squirt gun (not shown), for example, the handle 240 could be used to direct the squirt gun. If the head feature 160 includes a shield (not shown), the handle 240 could be used to maneuver the shield. Other operations are possible.

Figure 19:
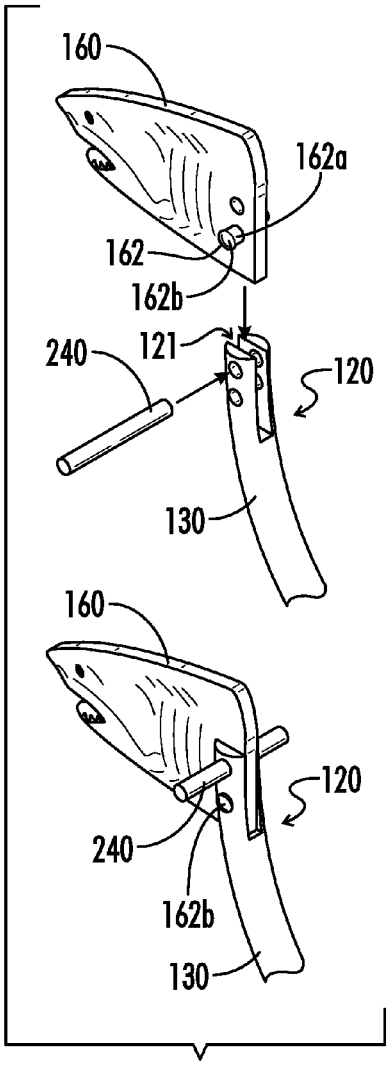
FIG. 19 illustrates one embodiment of a head feature being attached to a body of a water toy and with a handlebar.
Figure 20:
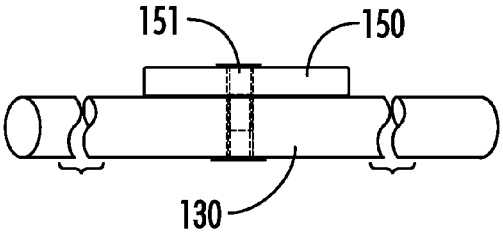
FIGS. 20-21 illustrate various embodiments of attaching a seat to a body with one or multiple fasteners.
Figure 21:
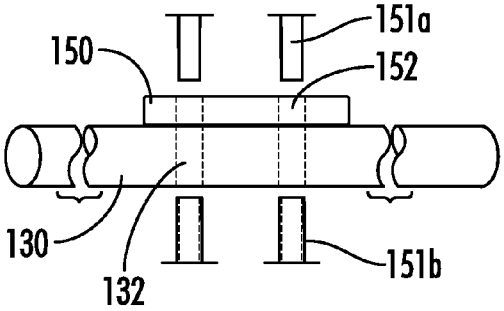
Figure 22:
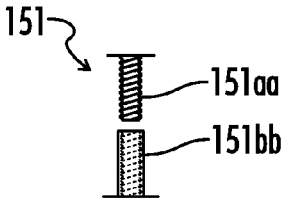
FIGS. 22-23 illustrate various embodiments of fasteners.
Figure 23:
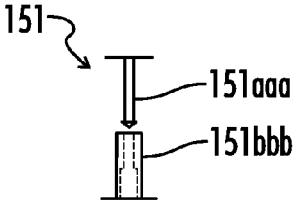
Figure 24:
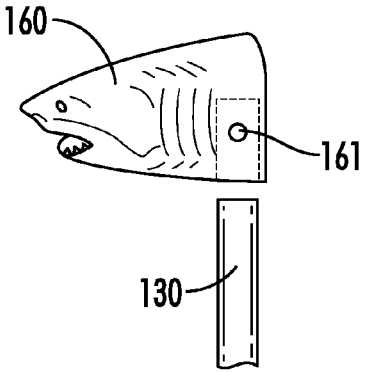
FIGS. 24-25 illustrate one embodiment of attaching a head feature to a body.
Figure 25:
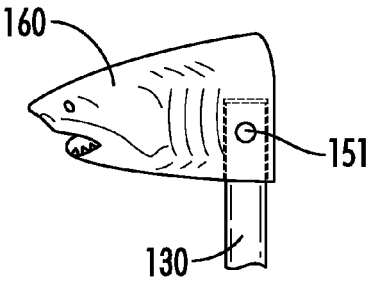
Figure 26:
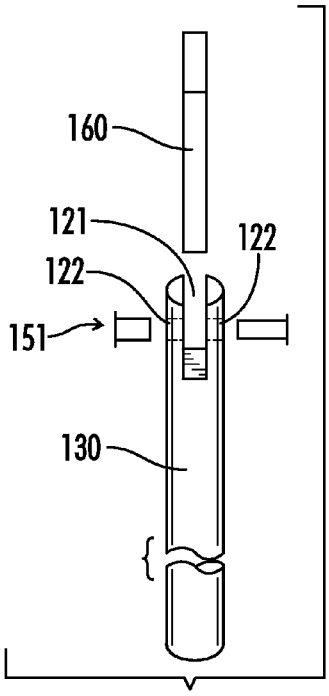
FIGS. 26-27 illustrate one embodiment of attaching a head feature to a body with one or multiple fasteners.
Figure 27:
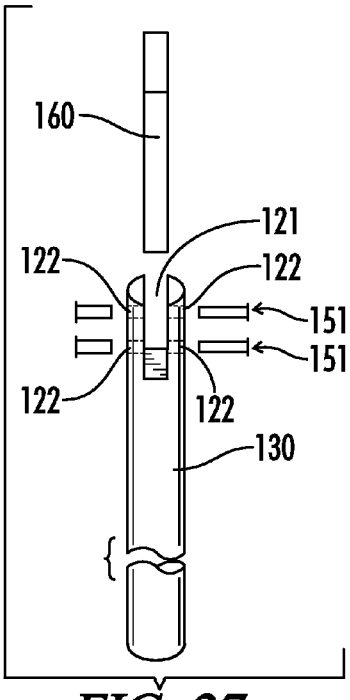

FIG. 19 illustrates one embodiment of a combination of FIGS. 17 and 18, which is another embodiment of a removable head feature 160 that is engaged with the body 130 through both a peg 162 and a handle 240 that extends through openings 122 on the end 120 of the body 130.

The head feature could be a two-dimensional structure formed from one or multiple layers of material and having graphics printed thereon, or it could be a three-dimensional structure having a realistic appearance. For example, with a two-dimensional structure having multiple layers of foam, the foam can be one color for the hair and one color for the face. If the two-dimensional structure is a shark, for example, it can be gray and the teeth can be white with an outline of black and different colors for the eyes. If the two-dimensional structure is a dragon, for example, it can be green with red eyes. Each foam layer can be formed with one or multiple colors, and similarly the layers can singularly or collectively be formed with one or multiple colors or combinations of colors as necessary. For example, the foam layers can have one layer and one color or to multiple layers and colors to be colorful like tropical fish or to attract customers favorite colors or the like. The features can be printed or made with foam or other material. The head feature 160 and/or tail feature 170 could be made with any type of material or any type of foam.

Figure 31:
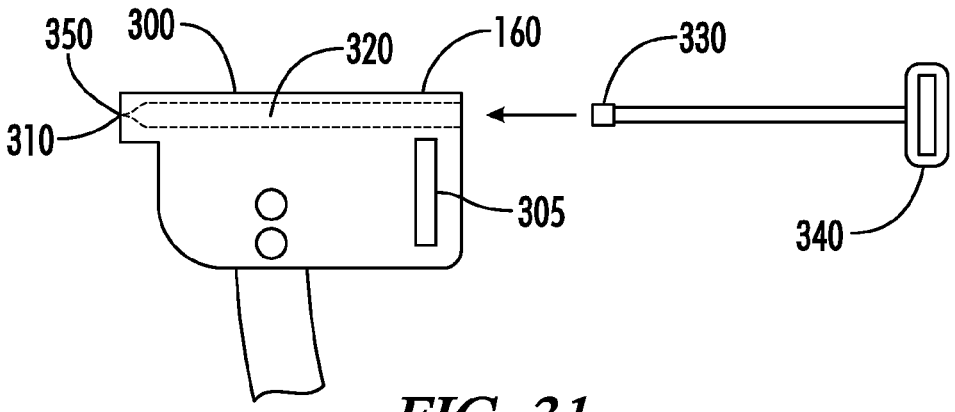
FIGS. 31-32 illustrate one embodiment of a squirt gun feature for attachment to a water toy body.
Figure 32:
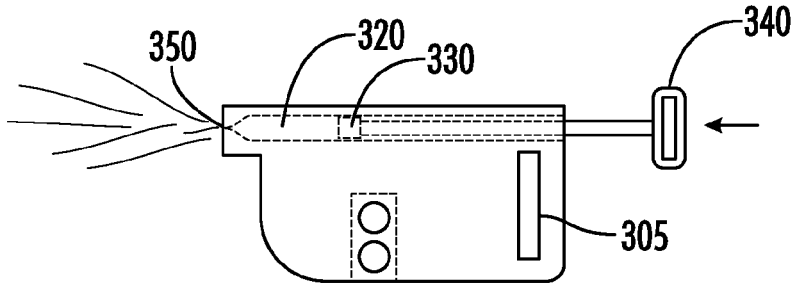
Figure 33:
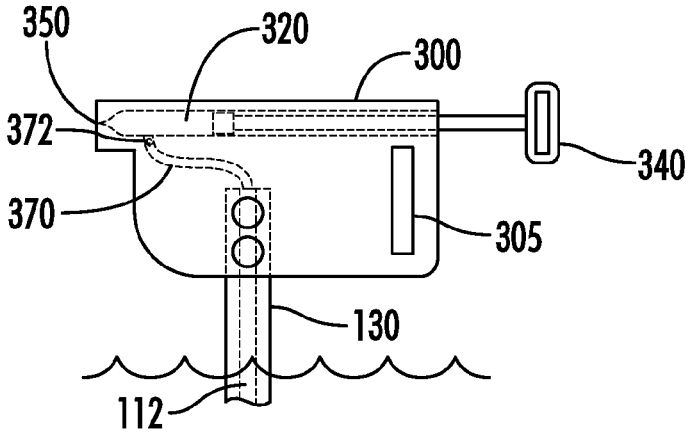
FIGS. 33-34 illustrate an alternative embodiment of a squirt gun feature for attachment to a water toy body.
Figure 34:
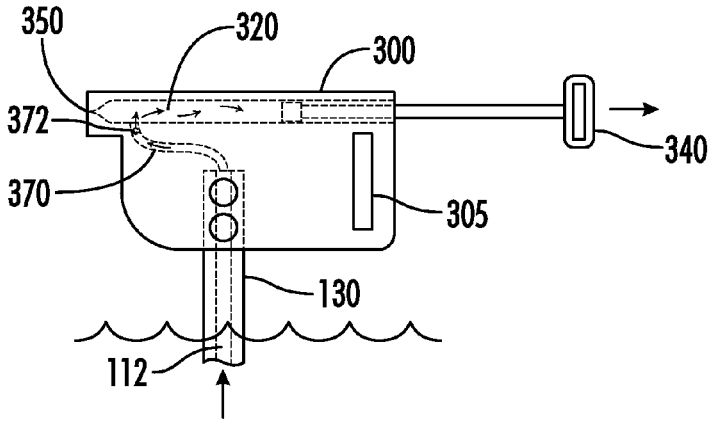

In addition to certain aesthetic variations, the head feature 160 could also have functional features such as, but not limited to handles and squirt guns attached by a leash or built in to the first end 120 or otherwise attached to the first end 120 or the body 130. The same applies to the tail feature 170 as will be described below. For example, as shown in FIG. 31, the head feature 160 could have a built in squirt gun 300 with handle 305 that is permanently or removably attached, where the water can come out of the mouth of a shark, for example, or where the water can come out of the outlet 310 of the water gun 300. In this example, the squirt gun 300 could have a water chamber 320 built inside with a plunger 330, handle 340 and nozzle 350, where the user can dip the outlet 310 into the water and pull back on the handle 340 and it sucks water into the chamber 320, whereby the user lifts the outlet 310 out of the water aims and shoots the water out the nozzle 350 by pushing the handle 340 and plunger 330 forward (FIG. 32). In this example, the nozzle can have one or several different types of nozzle openings such as, but not limited to, a fan, spray, shower or jet type nozzle opening. Other nozzle openings are possible. FIG. 33 illustrates a variation of a squirt gun 360 having an inlet 370 that is connected to the core 112 of the body 300 that functions as a water source for the water chamber 320, such that water is drawn into the chamber 320 through the inlet 370 upon pulling back on the handle 340 (FIG. 34). The inlet 370 has a one-way valve 372 that only allows water to be drawn into the chamber 320 from the body 300, and that upon pushing the handle 340 the water in the chamber 320 is pushed through the nozzle outlet 350. Other methods of operating a water gun are possible.

The squirt gun can be built inside or be built on the outside of the head or front, and can be removable or permanent. The squirt gun could be enclosed in foam or other material, and a handle of the squirt gun could be any material and could be covered with foam, including the chamber and the whole body of the squirt gun and it can be any shape or size. The head feature 160 with squirt gun can be turned in any direction, such as up and/or down, and is flexible due to the flexibility of the body 130 and the flexible connection of the head feature 160 with the body 130. Alternatively, the water source could emanate from a separate tube associated with the body 130, where the tube could come out of the head feature 160 or the tail feature 170 or some other place along the body 130. In either example, it is preferable if the water source is provided with a filter to prevent debris and the like from getting inside the system. The squirt gun feature can have a rail type feature like a shot gun.

The head feature 160 or front end region 120 can also have handle bars or hand rests if desired. One embodiment is disclosed in FIGS. 18 and 19. Other embodiments are possible. The head feature can be constructed so as to be used as a shield to block incoming splashing or squirting water. The head feature 160 and/or tail feature 170 could include a bubble maker or bubbler feature that makes bubbles through any means now known or hereinafter developed (such as through air injections), which bubbler feature could be built-in so that bubbles come out of a whale's mouth, for example. The head feature 160 and/or tail feature 170 could incorporate a drink holder, and/or a projectile launcher such as a Nerf (trademark) gun shooter that can shoot balls, arrows and/or any type of projectile. Other accessories can be incorporated into the toy 100 including, but not limited to, an umbrella, automatic squirt gun, one or more regular squirt guns, action figures or cartoon characters, cannons, bow and arrows, sun protectors other than an umbrella, hats like a shark fin that a user can use to look like a real shark (i.e. having a head, fin and tail), permanent or removable shields, etc. The toy and/or its accessories can be merchandised in cartons or point-of-purchase displays with the top portion open so the user can see the head feature 160, etc. The toy 100 can be displayed with a mannequin seated on the seat 150 to show how the toy 100 would appear in the water, or the display could have pictures illustrating the same.

If the first aesthetic feature 160 is actually in the shape or has the appearance of a head, or otherwise, it could be provided with some type of illumination including eyes or other light features that are movable or that light up, wherein the head feature 160 and/or body 130 would preferably include a power source to power the light features. The power source be any type or have batteries in a water safe compartment. Illumination could be provided to any aspect of the toy 100.

The tail feature 170 can incorporate the same features and functionality as described above in connection with the head feature 160. For example, the tail feature 170 can be made to detach or otherwise pop off under extreme wear and tear or in response to an extreme force, whereby the user can reattach or otherwise pop back on the tail in the same manner. The tail feature 170 can be any shape, design, construction, etc, and can be two-dimensional or three-dimensional as described above in connection with the head feature 160. The tail feature 170 could also have similar functional features such as a squirt gun, handlebars, splash shield, drink holder, illumination, etc. The tail feature 170 can be positioned vertical like a shark's tail or more horizontal like a dolphin's tail, or it can be shaped like a mermaid tail, for example. Other positioning is possible. It can be positioned at any location on the tube 110 and can be removable or permanently attached to the tube 110. As discussed above, depending on the weight of the rider the tail 170 can be in the water for heavier riders and barely touching the water when there's a lighter rider onboard. The tail feature 170 can be shaped any way possible, whether it looks like a real tail or not. The head feature 160 and/or tail feature 170 can also have a back rest and/or head rest as desired and no actual tail when there's a head in front.

The seat 150, head feature 160, and/or tail feature 170 can be connected to the tube 110 or body 130 using any means now known or hereinafter developed, some of which has previously been described in connection with FIGS. 24-30. For example, and to reiterate some of the previously described embodiments, the head feature 160 might include a reinforced or lined hole to receive a pin or bolt or other fastener extending through the hole for connection of the head feature 160 to the first end 120 of the body 130. The lined hole might include a plastic sleeve permanently or removably attached to the hole to increase the strength of the hole and to prevent the fastener from enlarging or otherwise breaching the integrity of the hole, especially since the hole is typically just an opening in a foam construction. Then a fastener or a connector that typically has one or two pieces can be connected through the body to attach the head feature and/or tail feature to the body. Alternatively, each of the main features can be attached to the tube 110 so that is can be easily removed or popped off, in which case the seat, head or tail feature might have a peg that is forced into a hole in the tube or body for a sturdy, removable connection during normal use, but that is still removable without extensive effort such that the user can pop off and on the feature as desired.

The connectors can be made from one or several pieces and be made out of any type of material, such as plastic or polyvinyl chloride (PVC) for example. In one example, the connector can have a male component and a female component where the two connectors are screwed together tight through openings in the head/tail feature and tube body, like a bolt screw and nut, where the connector head can have any configuration such as a Phillips head, standard or slotted, raised or indented, etc. The connector could use a flange or a washer to hold the foam pieces tightly together to offer more security. The connector could also be a punch-type of connector that is somewhat permanent that includes, for example, a male component having a large head that is forced into a much smaller hole on a female component such that the head cannot be removed from the hole once it is attached. In this case, the head might have an arrow shape with a flat bottom that prevents the head from being withdrawn backward. The connector can be placed through sleeves described or through the openings in the head/tail/seat and tube body.

In another embodiment, portions of the tube or body could be notched (see FIGS. 26-27 for example) to receive the head/tail feature to create an additional manner of connection, where the head/tail feature fits within the notch and then a fastener is used to secure the head/tail feature within the notch. Such a construction could be reversed, where the head/tail feature is provided with a notch and the body portion of the tube fits within the notch in the head/tail feature, and then all of the parts are fastened together through the notch and parts. While only certain methods of attachment are illustrated, it will be appreciated that the head/tail features and tube can be connected or attached using any means now known or hereinafter developed.

Figure 35:
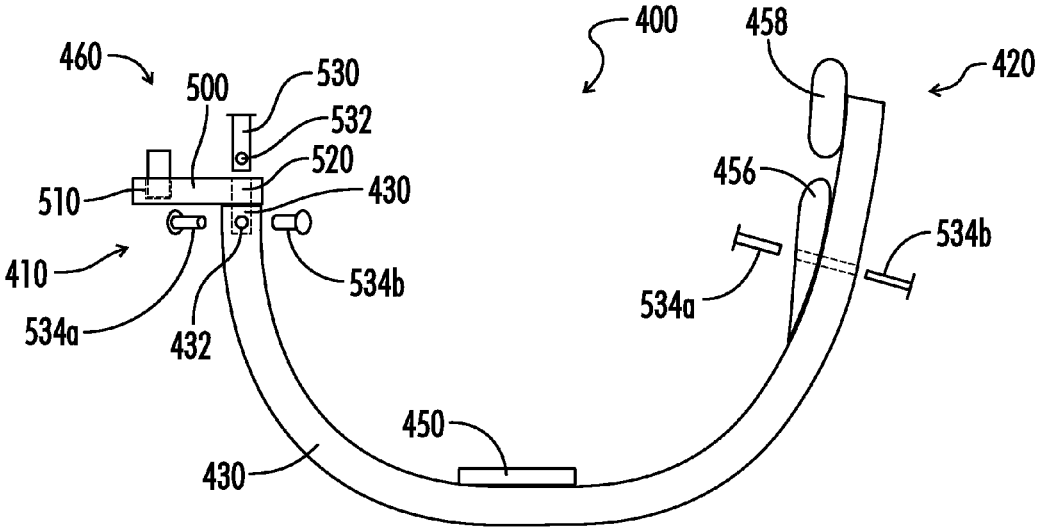
FIGS. 35-37 illustrate one embodiment of a lounger embodiment with a detailed view of a tray and backrest.
Figure 36:
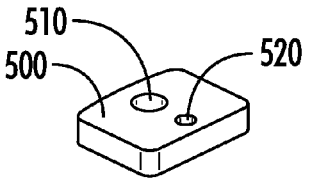
Figure 37:
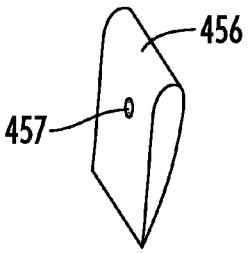
Figure 38:
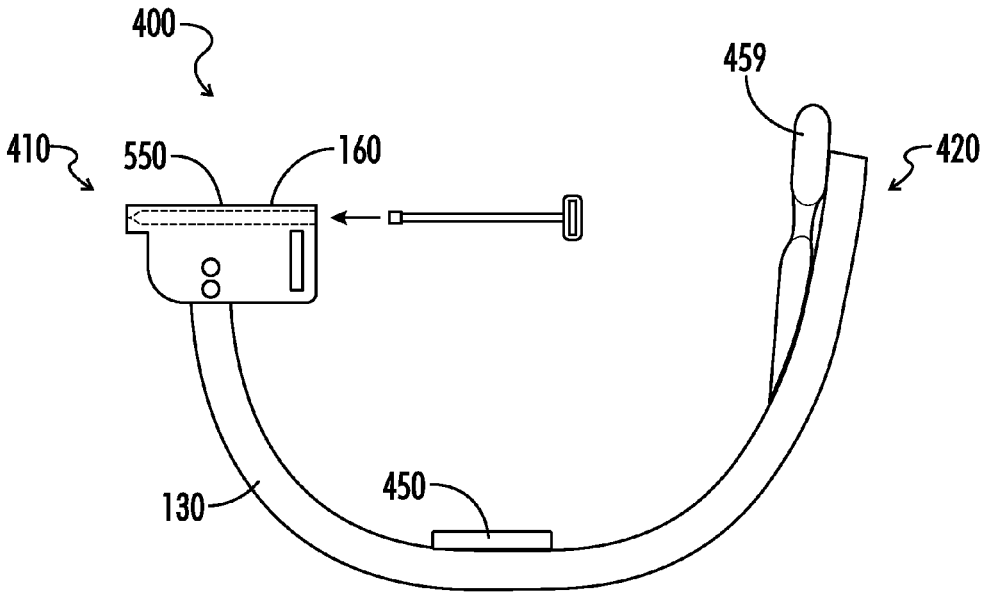
FIG. 38 illustrates one embodiment of a lounger embodiment with a squirt gun and a combination backrest and head rest.

In an alternative embodiment, the body might be used primarily as a lounger 400 instead of a toy as shown in FIGS. 35-39. For example, the lounger 400 can have first and second ends 410, 420, and a body 430, a head feature 460, a seat feature 450, a back rest 456 (FIG. 37), a neck and/or head rest 458, and even a tail feature 470 (not shown) if desired. The seat 450, back rest 456 and/or head rest 458 can be separate pieces or they can be combined into one piece (not shown). The front end 410 could also have a tray 500 (FIG. 36) with or without drink holders 510, an arm rest or hand rest, and/or handles, which can be any thickness, material, size, shape, color, or ornamentation, although it is preferable that the material is floatable. The edges of the tray 500 are preferably rounded and can be any size or shape. The user would hold the front, or side of the tray, which could also have handles. The tray or arm rest can be thicker on a side toward the user than the side away from the user, in which case the tray will be level, or it can be the same thickness. The tray can be removable or permanent. FIG. 35 illustrates one manner of attaching the tray 500 to the body 430 including the use of a pin 530 having an opening 532 that extends through an opening 520 in the tray 500 and into an opening 433 in the body 430, and whereby a fastener 534*a*, 534*b* attached through the opening 532 in the pin 530 and through opening 432 in the body 430 secures the pin 530 to the tray 500 and to the body 430. As shown in FIGS. 35 and 37, similar fasteners 534*a*, 534*b* could be used to attached the backrest 456 to the body 430 through a hole 457 in the backrest 456. The headrest 458 could be attached to the body 430 using similar means. As with other features described above, the tray or arm rest, as well as the head rest and neck rest, can be made to detach under extreme wear and tear and the user can re-attach the tray or arm rest as desired, using a less permanent fastener arrangement. The tray or arm rest, or any other accessory, can also be glued or molded into the body as one piece or connected with connectors. As shown in FIG. 38, a lounger 400 could also have a combination head rest and backrest 459, along with a squirt gun 550 permanently or removably attached to one end 410 or the other end 420 if desired. The lounger can have one to any number of seats. The back rest and head rest can be one to several pieces and can be removably or permanently connected.

Figure 39:
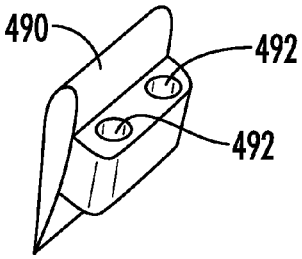
FIG. 39 illustrates one embodiment of a backrest for use with a double body lounger.

As shown in FIG. 37, in the lounger embodiment, it is preferable that a portion of the back rest closest to the lower back should be thinner than a portion of the back rest away from the lower back. It is preferable that the lowest point of the back rest is almost flat so it touches the same surface level as the body, then tapers upward gradually and thicker behind the head area. This way a user can lie back comfortably. The height position of the back and head rest on the body is important and has to be positioned properly otherwise the area between the seat and the back rest will be too close together. When this happens, the back rest will be too close to the user's lower back and the user will not be able to lean backward. FIG. 39 shows a variation of a back rest 490 having two openings 492 for attachment to two tubular bodies (not shown) arranged side by side for a larger double float or a larger double float lounger.

The lounger embodiment can also be enhanced to perform exercises. For example, a user can use the lounger and move their feet like riding a bike for low impact exercise and a good cardio workout while staying cool in the water. Additional accessories could include a heart rate monitor, calorie counter, timer, clock, bike mechanism including pedals and connectors for allowing movement of the pedals. The bike mechanism could have a waterproof metal chain, or a plastic chain, or no chain whatsoever so that the user is simply rotating pedals. The pedals could include paddles so when the user pedals the paddles, the user is propelled through the water. In this example, there could also include a rudder and a steering mechanism.

Figure 56:
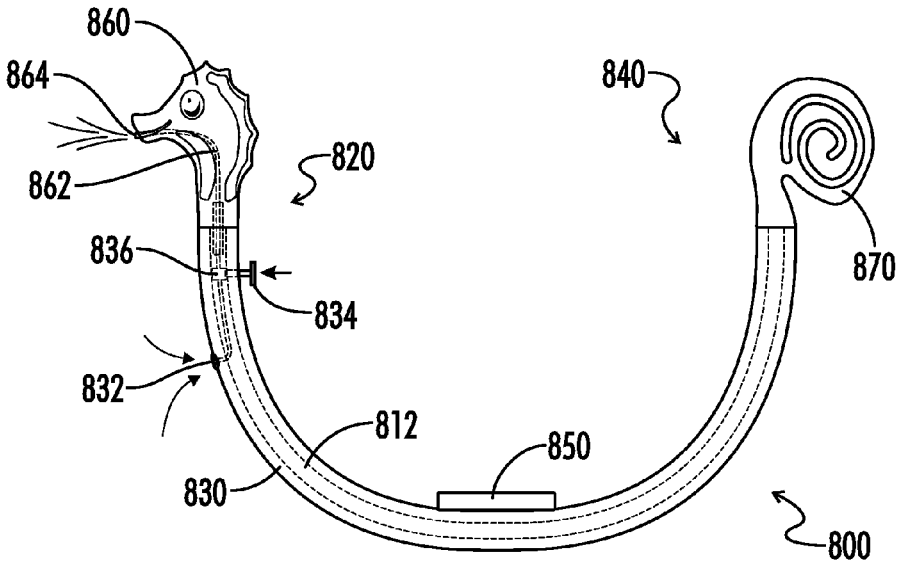
FIGS. 56-58 illustrate various embodiments of a water toy including a water gun.
Figure 57:
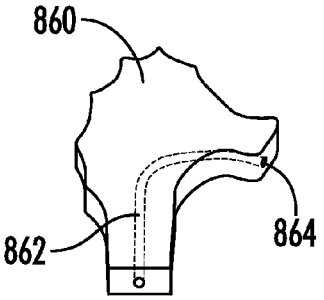
Figure 58:
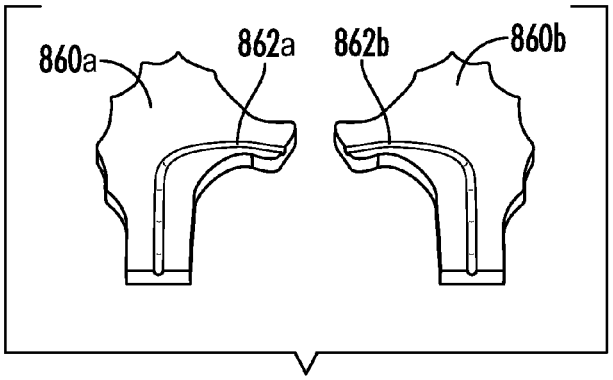

FIG. 56-58 illustrate an alternative embodiment of a water toy 800 having a water gun comprising a floatable foam tube 810 having a core 812, first end 820 with a head feature 860, a second end 840 with a tail feature 870, a body 830 between the first and second ends 820, 840, and a seat 850. The head feature 860, which is shaped like a sea horse in this embodiment, is provided with a water channel 862 and an outlet 864 that delivers water drawn in through an inlet 832 in the body 830 by a trigger handle 834 connected to a valve 836 that resides within the core 812 of the body 830. The handle 834, which can be any shape, size or configuration, can be positioned anywhere on the toy 800, preferably either on the body 830 or the head feature 860. The head feature that functions as a water gun can be any shape or configuration. When a user (not shown) pulls back on the handle 834, water is drawn through the inlet 832 into a chamber 838 in the body 830 and is directed by the valve 836 toward the water channel 862 in the head feature 860. When a user pushes the handle 834 toward the body 830, the water in the channel 862 is forced out of the head feature 860 through the outlet 864 and is prevented from being directed backward toward the inlet 832 by the valve 836. The channel 862 in the head feature 860 may be formed into the head feature 860 in a single manufacturing process (FIG. 57) or it may be formed by assembling the head feature 860 from two halves 860*a*, 860*b*, each half having a channel half 862*a*, 862*b* (FIG. 58). The outlet 864 can have nozzles designed for spraying water in any manner and in any direction, over short or long distances, and for spraying straight, a mist, flat, shower, jet or spraying in multiple directions. The water passage from the inlet 832 to the water channel 862 in the head feature 860 is preferably a flexible plastic tube of any shape, size, cross section and material, although a stiff material can be used. While the head feature 860 illustrates a water channel 862, it will be appreciated that the head feature can also include a water pump, trigger, multiple triggers or the like, and the water pump can be located anywhere including the body, head and/or tail.

Figure 59:
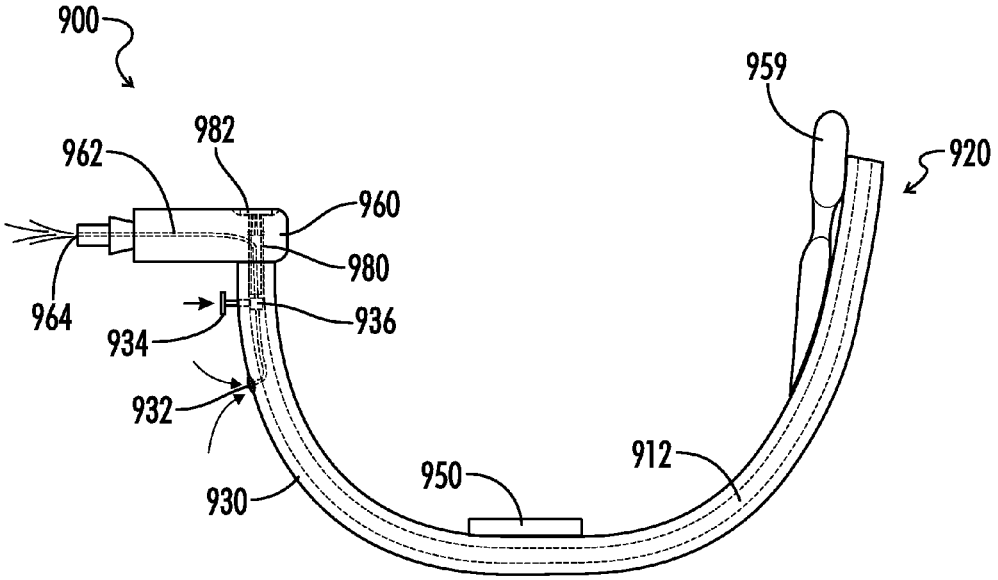
FIG. 59 illustrates one embodiment of a water toy including a water gun.

The position of the trigger handle can be located anywhere on the water toy, on the front, side, back or any position on the body or adjacent the head feature or tail feature, for example. The trigger button or handle usually is attached to the squirt gun pump and can be any size shape or design. It can be shaped like a round button, or like a trigger in any water squirt gun now known or hereinafter developed. There can also be multiple trigger buttons positioned on the body, head, tail or the like. The trigger button can also be spring-biased so that it only needs to be actuated in one direction to be operable. FIG. 59 illustrates an alternative embodiment of a water toy 900 having a water gun comprising a floatable foam tube 910 having a core 912, first end 920 with a head feature 960 in the shape of a gun, a second end 940 having a combination head rest and back rest 959, a body 930 between the first and second ends 920, 940, and a seat 950. The head feature 960 is provided with a water channel 962 and an outlet 964 that delivers water drawn in through an inlet 932 in the body 930 by a trigger handle 934 connected to a valve 936 that resides within the core 912 of the body 930. The inlet 932 should preferably reside on the front side of the body 930 about twelve to eighteen inches below the head feature 960. The inlet placement can be any distance and place and anywhere as long as it's under the water level, which is typically determined by the weight of the rider (not shown). The inlet 932 can have a filter such as a screen or grate (not shown) that is glued or attached any way permanently or can be removable, which prevents leaves or other debris from passing through the inlet 932 but which allows water to pass through the inlet 932. For example, the filter, screen or grate can be attached to the body 930 at the inlet 932 using a connector that extends from the inlet 932 through the body 930 and is anchored to the body 930. The handle 934, which can be any shape, size or configuration, can be positioned anywhere on the toy 900, preferably either on the body 930 or the head feature 960. The squirt gun head feature 960 can be any design or any shape known or hereinafter developed. It can be located anywhere adjacent the first end 920, second end 940 or body 930. The head feature 960 can be plastic or any type material. It can also have handle bars or have trigger buttons built in, as well as one to multiple trigger buttons, water channels and nozzles. The position of the trigger can be located anywhere on the water toy, on the front, side, back or any position on the body or adjacent the head feature or tail feature, for example. The trigger button or handle usually is attached to the squirt gun pump and can be any size shape or design. It can be shaped like a round button, or like a trigger in any water squirt gun now known or hereinafter developed. There can also be multiple trigger buttons positioned on the body, head, tail or the like. The trigger button can also be spring-biased so that it only needs to be actuated in one direction to be operable.

A portion of the water channel 962 and pump can be inside a fastener tube connector 980 that connects the head feature 960 or gun with the main body 930 (see FIG. 46 for example), which fastener tube connector 980 can also be used to anchor and support the water channel 962 relative to the body 930 through any means possible. The fastener tube connector 980 can be further attached to the head feature 960 by a cap 982 similar to the cap 670 of FIGS. 46-48.

Figure 60:
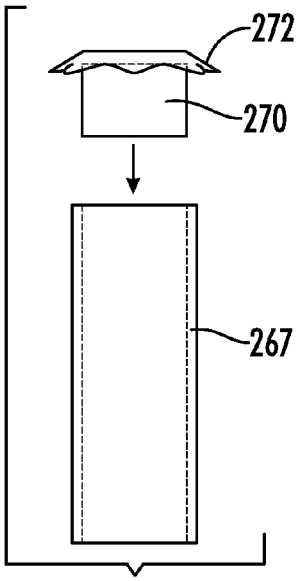
FIGS. 60-68 illustrate various embodiments of a fastener tube and cap.
Figure 61:
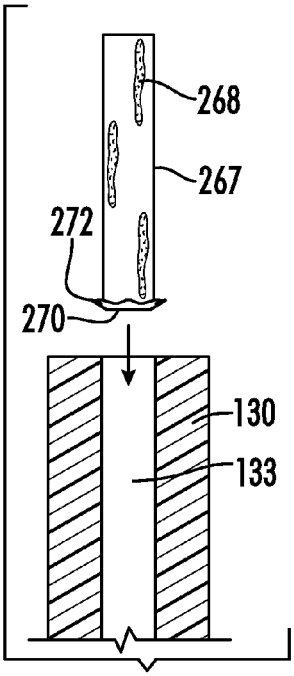
Figure 62:
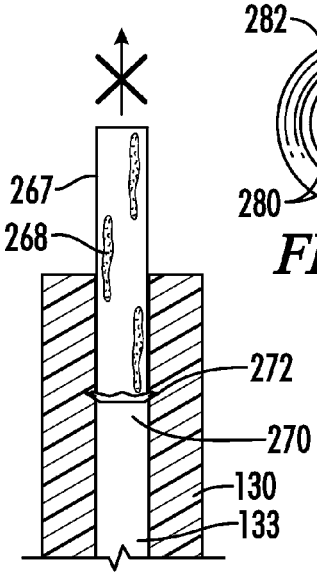

FIGS. 60-62 illustrate a variation of an embodiment of a fastener tube 267 similar to the fastener tube 257 of FIGS. 44-45, but wherein the fastener tube 267 is further provided with a cap 270 having an outwardly extended, angled peripheral edge 272 (FIG. 60) that is designed to allow for easy insertion of the combination tube 267 and cap 270 into an opening 133 of the body 130 (FIG. 61), but that is also designed to prevent the withdrawal of the tube 267 and cap 270 from the body 130 (FIG. 62). The tube 267 can be hollow or solid and be any shape or configuration. The cap 270 can be removably or permanently attached to the fastener tube 267 during manufacturing, or it can form an end of the fastener tube 267. In other words, the fastener tube 267 and cap 270 can be formed from a single piece. The tube 267 can also be provided with an adhesive 268 to further secure the tube 267 within the opening 133, which adhesive is preferably water-resistant and safe for children and the environment. The diameter of the edge 272 of the cap 270 is preferably sufficiently larger than the diameter of the tube 267 or of the opening 133 of the body 130 such that the cap 270 can be forced into the opening 133, pushing the body material around the opening 133 aside, but such that it can't be removed from the opening 130 (FIG. 62) without disrupting the integrity of the opening 133. The cap 270 is particularly useful for when the adhesive 268 (if applicable) wears away or dries out. In an environment shown in FIGS. 44-45 for example, the cap 270 may be applied to one or both ends of the fastener tube 257, 267, which would be useful to secure the ends of the fastener tube relative to the body and the head feature or the tail feature. If, for example, the adhesive 268 loosens up or some tries to pull the head or tail feature, or squirt gun, etc., out of the body 130, then the edge 272 of the cap 270 digs into the body 130 making the cap 270 into an anchor. In order for the head or tail feature, etc. to be removed from the body 130, the adhesive 268 (if applicable) would have to loosen up and the edge 272 would have to tear out all the foam from adjacent the opening 133 until the fastener tube 267 with cap 270 is removed from the body 130. The edge 272 can be sharp so it can dig and anchor into the foam body better. Thus, use of a tube 267 and cap 270 can help anchor the head and/or tail feature to the body.

Figure 63:
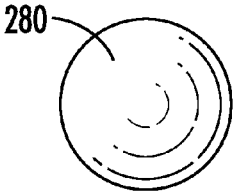
Figure 66:
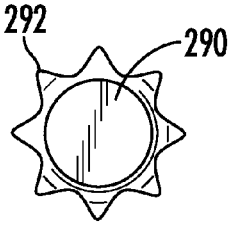
Figure 64:
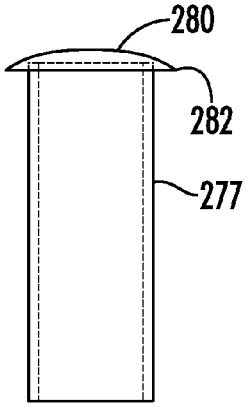
Figure 67:
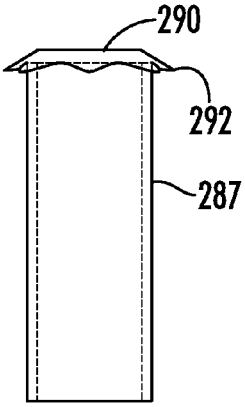
Figure 65:
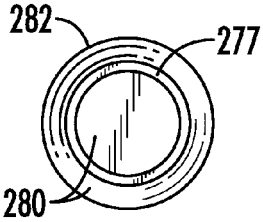
Figure 68:
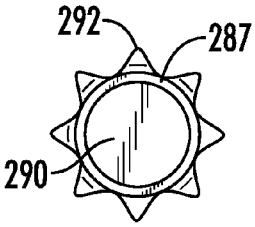

In the above scenario, the use of an adhesive 268 might be sufficient security to hold the fastener tube 267 in place relative to a head feature, tail feature or the like. The use of a cap 270 is added security to make sure the head element, tail element, squirt gun, etc., do not inadvertently separate from the body 130. The edge 272 of the cap 270 can form a variety of configurations as shown in the embodiment of FIGS. 63-65 showing a fastener tube 277 with a cap 280 having a rounded edge 282, as well as shown in the embodiment of FIGS. 66-68 showing a fastener tube 287 with a cap 290 having a jagged edge 292 with claws. Other embodiments of cap designs and cap edge designs are contemplated.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A water toy comprising:

a foam tube having a first end, a second end and a body therebetween;

at least one of a first aesthetic feature or a first functional feature attached to the first end;

at least one of a second aesthetic feature or a second functional feature attached to the second end; and a seat permanently coupled to the body and being a separate component from the body, the seat being substantially planar, the seat having a bottom surface that contacts a top surface of the body and is disposed entirely above a bottom surface of the body when coupled to the body, the seat defining a plurality of openings, each opening from the plurality of openings configured to receive a fastener tube from a plurality of fastener tubes, each fastener tube from the plurality of fastener tubes permanently coupling the seat to the body with caps having spring-biased prongs that engage with openings in each fastener tube from the plurality of fastener tubes.

2. The water toy of claim 1, wherein the foam tube further comprises a hollow core.

3. The water toy of claim 2, wherein at least one of the first aesthetic feature or the first functional feature resembles a head.

4. The water toy of claim 3, wherein the head is in the shape of at least one of a mermaid, shark, alligator, dolphin, whale, sea horse, fish, tropical fish, person, products, cartoon figure, dragon, action figure, cannon, eel, snake, walrus, or any animal or sea creature.

5. The water toy of claim 1, wherein at least one of the first aesthetic feature, the second aesthetic feature, the first functional feature, or the second functional feature further includes at least one layer of foam.

6. The water toy of claim 1, wherein the at least one of the first aesthetic feature or the first functional feature includes a squirt gun.

7. The water toy of claim 6, wherein the squirt gun further comprises a water source configured to provide water to be expelled from the body.

8. The water toy of claim 7, further comprising:

a water channel defined at least in part by the body and a water inlet defined by the body and in fluid communication with the water channel; and a filter coupled to the body and configured to prevent debris from passing through the water inlet.

9. The water toy of claim 8, wherein the filter is supported by the body by a connector.

10. The water toy of claim 1, wherein at least one of the first aesthetic feature, the first functional feature, the second aesthetic feature, the second functional feature is connected to the body with a connector.

11. The water toy of claim 10, wherein the connector further comprises an adhesive.

12. The water toy of claim 11, wherein the connector is insertable into a first opening in the body and into a second opening in one of the first aesthetic feature, the first functional feature, the second aesthetic feature, the second functional feature, and the seat.

13. The water toy of claim 10, wherein the connector further includes a cap having an enlarged flange that provides for one of a permanent and a semi-permanent connection with at least the body.

14. The water toy of claim 13, wherein the enlarged flange further includes an angled outer edge.

15. The water toy of claim 14, wherein the outer edge has a jagged periphery.

16. The water toy of claim 13, wherein the connector and cap are formed as a single piece.

17. The water toy of claim 1, wherein the body has a length, the seat being disposed on the body at or near a mid-point along the length of the body.

18. A water toy, comprising:

a foam tube having a body with a first end and a second end, the body defining an opening extending through a thickness of the body at a location between the first end and the second end of the body;

a seat permanently coupled to the body and being a separate component from the body, the seat being substantially planar, the seat having a bottom surface that contacts a top surface of the body and is disposed entirely above a bottom surface of the body when coupled to the body, the seat defining an opening extending through a thickness of the seat and substantially aligned with the opening of the body; and a connector connecting the seat to the foam tube, the connector including a fastener tube, a first cap and a second cap, the fastener tube having a first end and a second end and being received through the opening of the seat and through the opening of the foam tube, the first cap being coupled to the first end of the fastener tube and including a pair of spring-biased prong members each including a projection that is received within a different opening defined in a side wall of the fastener tube, the second cap being coupled to the second end of the fastener tube and including a pair of spring-biased prong members each including a projection that is received within a different opening defined in a side wall of the fastener tube, the seat and the foam tube being disposed between the first cap and the second cap.

19. The water toy of claim 18, wherein the first cap and the second cap each includes a flange having a diameter at least twice a diameter of the fastener tube such that a sufficient surface area of the flange of the first cap contacts a top surface of the seat and a sufficient surface area of the flange of the second cap contacts a bottom surface of the body to prevent the seat and the body from becoming separated.

20. The water toy of claim 18, wherein the connector has a length that is shorter than a combined thickness of the seat and the body such that the seat and the body are coupled together with a compressive fit.

21. The water toy of claim 18, wherein the connector has a length that is shorter than a combined thickness of the seat and the body such that the seat and the body are coupled together with a compressive fit such that an outer surface of the first cap is substantially flush with a top surface of the seat and an outer surface of the second cap is substantially flush with a bottom surface of the body.

22. The water toy of claim 18, further comprising:

at least one of a first aesthetic feature or a first functional feature attached to the first end of the body; and at least one of a second aesthetic feature or a second functional feature attached to the second end of the body.

23. The water toy of claim 18, wherein the body has a length, the seat being disposed on the body at or near a mid-point along the length of the body.

24. The water toy of claim 18, wherein:

each spring-biased prong member of the pair of spring-biased prong members of the first cap includes an angled prong end that engages an inside surface of the side wall of the fastener tube, and each spring-biased prong member of the pair of spring-biased prong members of the second cap includes an angled prong end that engages the inside surface of the side wall of the fastener tube.

25. A water toy, comprising:

a foam tube having a body with a first end and a second end, the body defining an opening extending through a thickness of the body at a location between the first end and the second end of the body;

a seat permanently coupled to the body and being a separate component from the body, the seat being substantially planar, the seat having a bottom surface that contacts a top surface of the body and is disposed entirely above a bottom surface of the body when coupled to the body, the seat defining an opening extending through a thickness of the seat and substantially aligned with the opening of the body; and a connector connecting the seat to the foam tube, the connector including a fastener tube, a first cap coupled to a first end of the fastener tube, and a second cap coupled to a second end of the fastener tube, the connector having a length that is shorter than a combined thickness of the seat and the body such that the seat and the body are coupled together with a compressive fit between the first cap and the second cap.

26. The water toy of claim 25, wherein an outer surface of the first cap is substantially flush with a top surface of the seat and an outer surface of the second cap is substantially flush with a bottom surface of the body.

27. The water toy of claim 25, wherein the connector is a first connector, the opening in the seat is a first opening in the seat, the opening in the body is a first opening in the body, the water toy further comprising:

a second connector connecting the seat to the body, the second connector received through a second opening defined in the seat through the thickness of the seat and received through a second opening defined in the body through the thickness of the body.

28. The water toy of claim 25, further comprising:

at least one of a first aesthetic feature or a first functional feature attached to the first end of the body; and at least one of a second aesthetic feature or a second functional feature attached to the second end of the body.

29. The water toy of claim 25, wherein the body has a length, the seat being disposed on the body at or near a mid-point along the length of the body.

* * * * *